US009782911B1

(12) United States Patent
Garrett et al.

(10) Patent No.: US 9,782,911 B1
(45) Date of Patent: Oct. 10, 2017

(54) SYSTEMS, METHODS AND APPARATUS FOR THE PRODUCTION OF FINGER JOINTED DIMENSIONED LUMBER, POLES, BEAMS AND MOLDING STOCK FROM GREEN ROUGH TRIM BLOCKS

(71) Applicants: Victor H. Garrett, Woodbine, GA (US); John H. Koerner, Middleburg, FL (US)

(72) Inventors: Victor H. Garrett, Woodbine, GA (US); John H. Koerner, Middleburg, FL (US)

(73) Assignee: GTK, LLC, Albany, GA (US)

( * ) Notice: Subject to any disclaimer, the term of this patent is extended or adjusted under 35 U.S.C. 154(b) by 489 days.

(21) Appl. No.: 14/307,699

(22) Filed: Jun. 18, 2014

Related U.S. Application Data

(60) Provisional application No. 61/836,746, filed on Jun. 19, 2013.

(51) Int. Cl.
*B27M 3/00* (2006.01)
*B27M 1/08* (2006.01)
*B27F 1/16* (2006.01)

(52) U.S. Cl.
CPC ..... *B27M 3/0013* (2013.01); *B27F 1/16* (2013.01); *B27M 1/08* (2013.01)

(58) Field of Classification Search
CPC ..... B27M 1/08; B27F 1/16
See application file for complete search history.

(56) References Cited

U.S. PATENT DOCUMENTS

| | | | | |
|---|---|---|---|---|
| 3,661,331 | A * | 5/1972 | Ballew | B27L 11/02 241/92 |
| 4,111,247 | A * | 9/1978 | Hasenwinkle | B27B 1/005 144/350 |
| 4,248,280 | A | 2/1981 | Taylor | |
| 4,500,385 | A | 2/1985 | Waggoner | |
| 4,742,920 | A | 5/1988 | Doherty | |
| 4,805,679 | A | 2/1989 | Czinner | |
| 4,879,659 | A | 11/1989 | Bowlin et al. | |
| 4,922,624 | A * | 5/1990 | Tharpe | F26B 21/06 34/191 |
| 4,941,357 | A | 7/1990 | Schajer | |
| 4,941,521 | A | 7/1990 | Redekop et al. | |
| 4,972,154 | A | 11/1990 | Bechtel et al. | |
| 5,237,870 | A | 8/1993 | Fry et al. | |
| 5,881,786 | A * | 3/1999 | Wilderman | B27B 1/007 144/3.1 |
| 5,944,928 | A | 8/1999 | Seidner | |
| 5,960,104 | A | 9/1999 | Conners et al. | |
| 6,203,653 | B1 | 3/2001 | Seidner | |
| 6,358,352 | B1 | 3/2002 | Schmidt | |
| 6,779,576 | B2 | 8/2004 | Cable | |
| 7,166,181 | B2 | 1/2007 | Cable | |
| 7,240,712 | B2 | 7/2007 | Cable | |
| 8,088,494 | B2 * | 1/2012 | Bosson | B27M 1/08 144/345 |

* cited by examiner

*Primary Examiner* — Matthew G Katcoff
(74) *Attorney, Agent, or Firm* — Allen Dyer Doppelt & Gilchrist

(57) ABSTRACT

Systems, methods and apparatus for the production of quality finger jointed dimensioned lumber, molding stock, poles or beams from green rough trim blocks by sorting, drying, finger jointing and finishing, thereby producing a commercial product having a higher commercial value.

13 Claims, 12 Drawing Sheets

SYSTEMS, METHODS AND APPARATUS FOR THE PRODUCTION OF FINGER JOINTED DIMENSIONED LUMBER, POLES, BEAMS AND MOLDING STOCK FROM GREEN ROUGH TRIM BLOCKS

CROSS REFERENCE TO RELATED APPLICATION

This application claims the benefit of U.S. Provisional Patent Application No. 61/836,746 filed Jun. 19, 2013, and entitled "Systems, Methods and Apparatus for the Production of Finger Jointed Dimensioned Lumber and Molding Stock From Green Rough Trim Blocks", which is incorporated herein by reference.

BACKGROUND

The present invention relates generally to systems, apparatus and methods for the production of finger jointed dimensioned lumber, molding stock, poles and beams produced from sawmill green rough trim.

The United States (U.S.) has substantial timber forests as a source of logs for the production of forest products such as paper, dimensional boards, sheets boards, poles, beams and pressed formed wood fiber products. Though the number of U.S. forest acres have been reduced by 50% over the past 200 years, logs are now harvested on a rotational basis providing a sustainable supply of timber. Furthermore, production facilities continually optimize their wood fiber usage which is typically the most expensive component of their product.

As an example, the production of dimensional lumber is a sequential process starting with de-limbed green logs and ending with stacks of dried boards having width, length and thickness dimensions. The sequential process usually comprises the following steps:

- Log bucking (cutting the tree length logs into saw length);
- Primary breakdown of the saw log;
- Secondary breakdown of the rough cants, fitches, and boards;
- Length trimming of the green boards;
- Collating, stacking, and drying of like-sized green boards;
- Surface finishing (planing or molding) of the dry rough boards;
- Length trimming of the finished dried boards;
- Collating and stacking for commercial distribution.

These sequential steps are common whether the lumber facility is a small single band mill or a high volume multi-primary breakdown facility. The processing of cylindrical poles (as utility poles, for example) and wooden beams utilize similar processes.

One type of forest product high volume production mill is a chip and saw ("CNS") facility. A CNS facility produces dimensional lumber from timber that has a diameter ranging from mid-sized to small. The CNS production concept was developed to produce higher value dimensional lumber while providing a source of white chips for paper production using the smaller diameter logs. A typical CNS facility generates an average of more than five-hundred tons of dry biomass byproducts per day. (According to Marks Mechanical Engineering Handbook, the standard for "dry" is defined as twelve percent moisture content or less.) These biomass byproducts typically comprise white chips, bark, sawdust, and wood shavings. The white chips produced by a CNS facility are sold to paper-producing mills for processing into paper and cellulose products. The bark, sawdust and shavings are either used at the CNS facility as a thermal energy source or sold as lower value byproducts. While manufacturing dimensional lumber, a CNS facility will also produce green rough trim blocks having a moisture content of over 40% as well as dry trim blocks with moisture content under 20%. According to Southern Pine Inspection Bureau ("SPIB") guidelines, construction grade lumber two inches thick with a moisture of 19% is known as KD19.

Green rough trim blocks are chipped and added to the white chips that are sold to the paper production industry or to post mill processing facilities such as pellet manufacturers. The production plant continually optimizes the log bucking and primary breakdown to minimize the number and amount of green rough trim blocks produced due to their lower value. CNS production mills currently produce approximately 14% of their production volume as green rough trim blocks. Approximately 40% of the green rough trim blocks can be converted into finger jointed dimensional lumber while approximately 20% of the green rough trim blocks can be converted into finger jointed molding blocks used to manufacture molding trim.

The dry trim blocks are ground into fuel for direct fired drying kiln or sold as low value stock for additional processing such as pallet components; truss web; or finger jointed dimensional lumber. Finger jointed lumber manufactured from dry finished trim blocks typically does not have sufficient fiber for finishing into dimensional lumber following the finger jointing process. The resulting boards have undesirable steps and offsets at the finger joints and inferior joints due to the insufficient material prior to the finger jointing process.

The production of dimensional lumber follows industry grading rules such as those promulgated by the SPIB. These rules provide the following minimum allowances for thickness, width, and length of the finished products:

- Thickness: based on a quarter system expressed as four quarter, (one inch); five quarter, (one and one quarter); eight quarter, (two inches), etc.;
- Width: based on two inch increments starting with a four; six; eight; ten; and twelve; and
- Length: based on two foot increments; six; eight; ten; twelve; fourteen; sixteen; eighteen and twenty.

All finished dimensions are based on dry lumber; therefore, the production mill must allow for shrinkage due to drying and other process variables. Thickness and width are fractional inch increases while the length increase is in inches. Following primary and secondary breakdown, the green lumber is trimmed, for example, on two foot lengths. In the past, the resulting green rough trim blocks have been collected and chipped into white chips at a commodity value. Processing the green rough trim blocks into finger jointed dimensional lumber and finger jointed molding blocks can increase their utility and value.

An issue with the production of kiln dried lumber is the defects incurred during the drying process. Warping, checking, splitting, and case hardening all reduce the amount of dried rough boards available for finishing into dimensioned lumber for market.

What is needed is a system, method and apparatus to utilize green rough trim blocks for production of high quality finished finger jointed dimensional lumber and molding stock.

SUMMARY OF THE INVENTION

The present invention is directed to systems, apparatus and methods utilizing green rough trim blocks for the production of dried finger jointed dimensional lumber, molding stock, poles and beams using apparatus and steps that dry the blocks followed by finger-jointing, planing and trimming. This invention discloses several embodiments for achieving these objectives.

If there is sufficient green rough trim block production then the finger jointing system can be co-located with a sawmill that generates the green rough trim blocks as a by-product, and where the existing lumber production facilities and machinery can be used to process the finger jointed trim blocks. A preferred embodiment is the co-location of the selection and drying of the green rough trim blocks with a sawmill that generates the green rough trim blocks as a by-product and a finger jointing facility designed to accept the dried rough trim blocks from multiple lumber production facilities.

According to the present invention, the green rough trim blocks are collected and subjected to a first sorting step based on grain density, shape, and defects using optimization hardware and software. Selected and sorted green rough trim blocks are then randomly stacked into a container with open mesh sides for kiln drying, and then placed into a dry kiln at the beginning of the drying cycle along with standard length green dimension lumber, poles or beams and thereby exposed to the drying process. At the end of the drying cycle, the unfinished trim blocks have a desirable uniform low moisture content, have low warping and are suitable for finger jointing. The dry rough trim blocks are then delivered to a finger jointing system where they are rough planed, followed by a second sorting step to be sorted by selection criteria to reject trim blocks such as, for example, ones that include edge wane or knots. The selected trim blocks are then processed through the finger jointing production system including finish planing and length trimming. The finished finger jointed dimensioned lumber, molding stock, poles or beams are then stacked for sale.

In a preferred embodiment, a finger jointing production plant receives dried trim blocks from multiple lumber production facilities. The finger jointing plant is sized and optimized for the volume of green rough trim blocks produced by multiple lumber production facilities.

BRIEF DESCRIPTION OF THE DRAWINGS

The novel features which are believed to be characteristic of this invention are set forth with particularity in the accompanying drawings and the following description, both as to its organization and method of operation, together with further objects and advantages thereof. These may best be understood by reference to the following description taken in connection with the accompanying drawings, in which.

DETAILED DESCRIPTION

Figure 1:
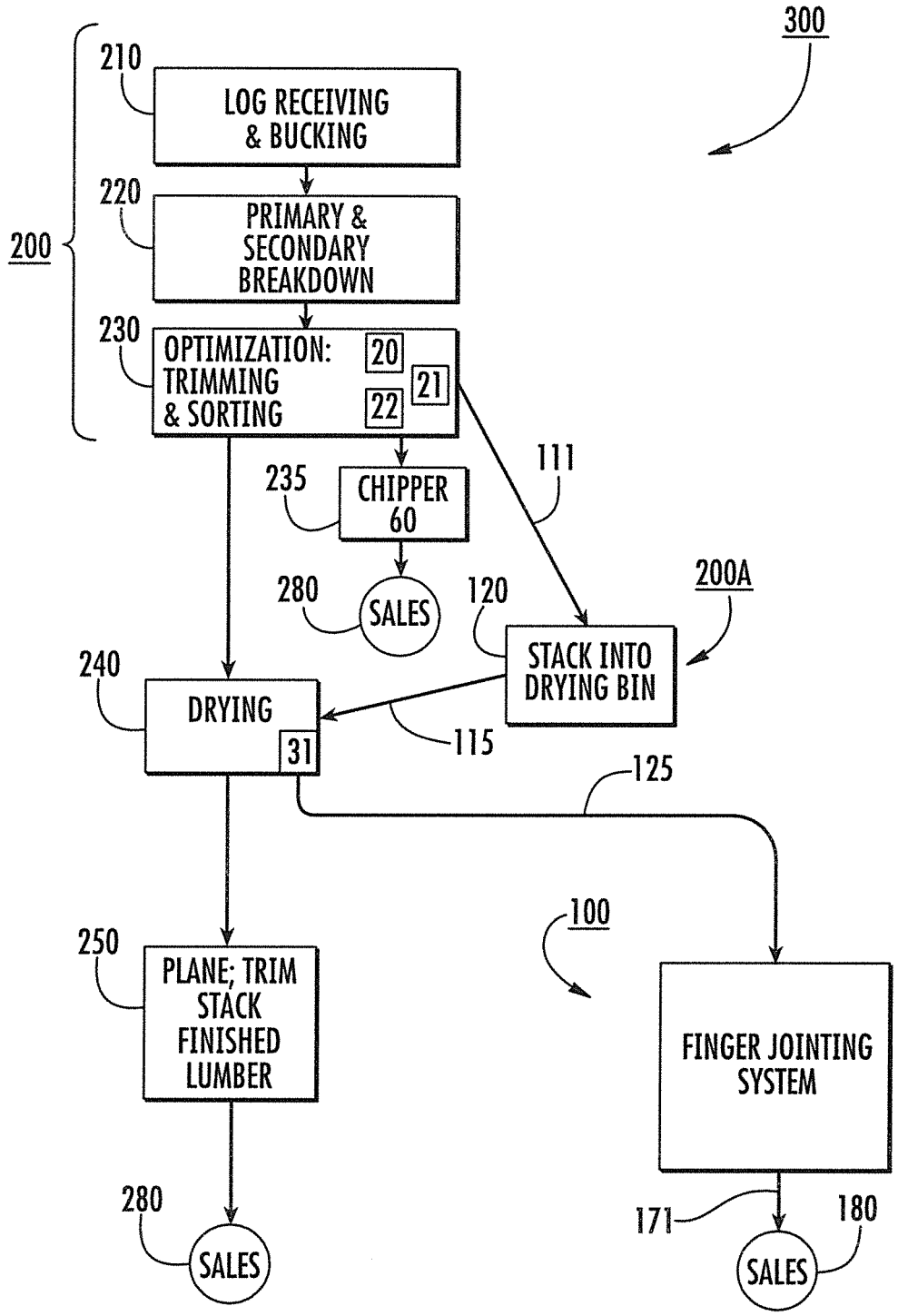
FIG. 1 is a flow diagram of an embodiment for the production of finger jointed lumber and molding stock using green rough trim blocks in accordance with this invention at, for example, a co-located lumber and finger jointing production facility.

A first embodiment of a co-located system in accordance with the invention is depicted in FIG. 1 and designated generally by reference numeral 300.

The system 300 comprises a lumber production facility 200 having a drying system 200A and a finger jointing production facility 100. The green rough trim blocks 20 produced by the lumber production facility 200 shown as flow 111 are dried by the drying system 200A and delivered as flow 125 to the finger jointing facility 100, for processing into finger jointed blocks and molding stock that are the commercial finger jointed products of the production facility 300.

Continuing with FIG. 1, the lumber production facility 200 receives logs and bucks them at step 210 (cut to rough lumber dimension length) for processing into dimensional lumber. Step 220 produces the primary and secondary breakdown of the bucked logs from step 210. Green rough boards are optimized, length trimmed and sorted at step 230 where green rough trim blocks 20 are produced during production of the dimensional green lumber as a by-product of the lumber production facility 200. During optimization of the green rough boards at step 230, green rough trim blocks 20 are separated into rejected green rough trim blocks 22 and green rough trim blocks 21 for drying. Rejected green rough trim blocks 22 are delivered to the chipper 235 to be rendered into green chips 60 and sold at step 280. The green rough trim blocks 21 for drying moves as flow 111 into the drying system 200A.

Turning to FIGS. 1, 4, 5, and 6, the green rough trim blocks 21 for drying are randomly stacked into a container 350 (FIG. 4) with opposing sides 320, opposing ends 310 and closed bottom 330. The container 350 with the green rough trim blocks 21 randomly stacked as shown as elements 55 in FIG. 5, and then moved for drying to area 240 shown as flow 115 in FIG. 1.

Figure 6:
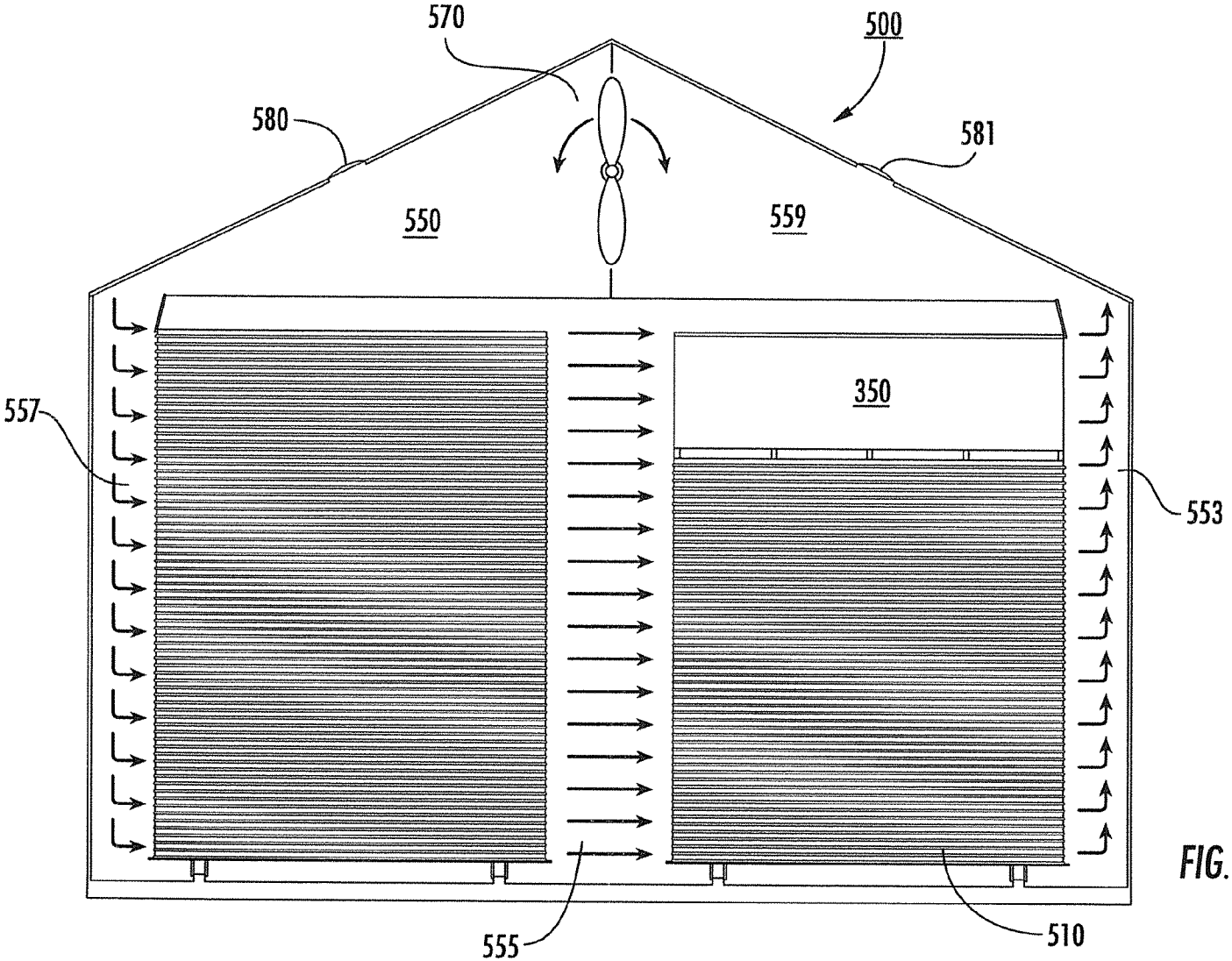
FIG. 6 is an end view of the filled container of FIG. 5 positioned with dimensional lumber for kiln drying.

The containers 350, with the randomly stacked green rough trim 21 blocks for drying are then kiln-dried by system 500 in FIG. 6. Container 350 is sized to fit with a stack of dimensional lumber inside the drying kiln 500. The container 350 is placed on the top of a stack of green dimensional lumber 510. Dry heated air 550 shown as flows 553, 555, 557 is pushed through the stack of lumber 510 and the container 350 by reversible fan 570. High moisture content air 559 enters the reheating area where the vents 580 and 581 are actuated to control the humidity of the heated air 550 and thereby controls the rate of drying.

Reversible fan 570 forces the heated air 550 to flow in the direction as indicated as arrows 553, 555, 557 and the opposite direction when the revisable fan 570 reverses. This provides uniform drying of the kiln charge made up of the lumber stack 510 and the container 350. The dried rough trim blocks 31 are delivered as flow 125 to the finger jointing system 100.

Figure 2:
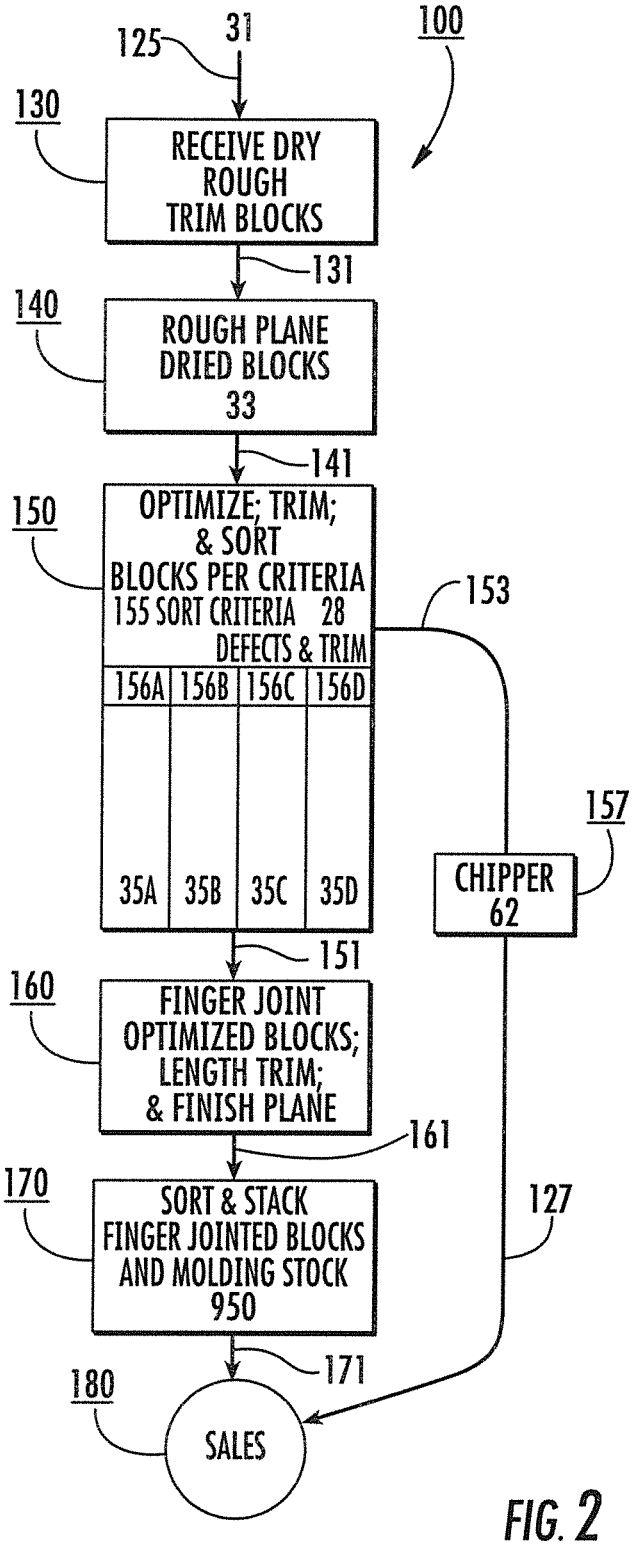
FIG. 2 is a detailed flow diagram for the production of finger jointed lumber and molding stock using dried rough trim blocks selected in accordance with this invention.

Turning now to FIG. 2, the dry rough trim blocks 31 are received by the finger jointing system 100 as flow 125 at receiving area 130. A variety of techniques for finger jointing are well known in the art, as shown in U.S. Pat. Nos. 4,248,280 and 4,941,521 which are incorporated by reference.

According to this invention, the dry rough trim blocks 31 move as flow 131 into the rough plane at step 140 where they are lightly surface planed prior to optimization at step 150. The dry rough planed trim blocks 33 move as flow 141 into the optimizer, trimmer, and sorter area 150.

Figure 7:
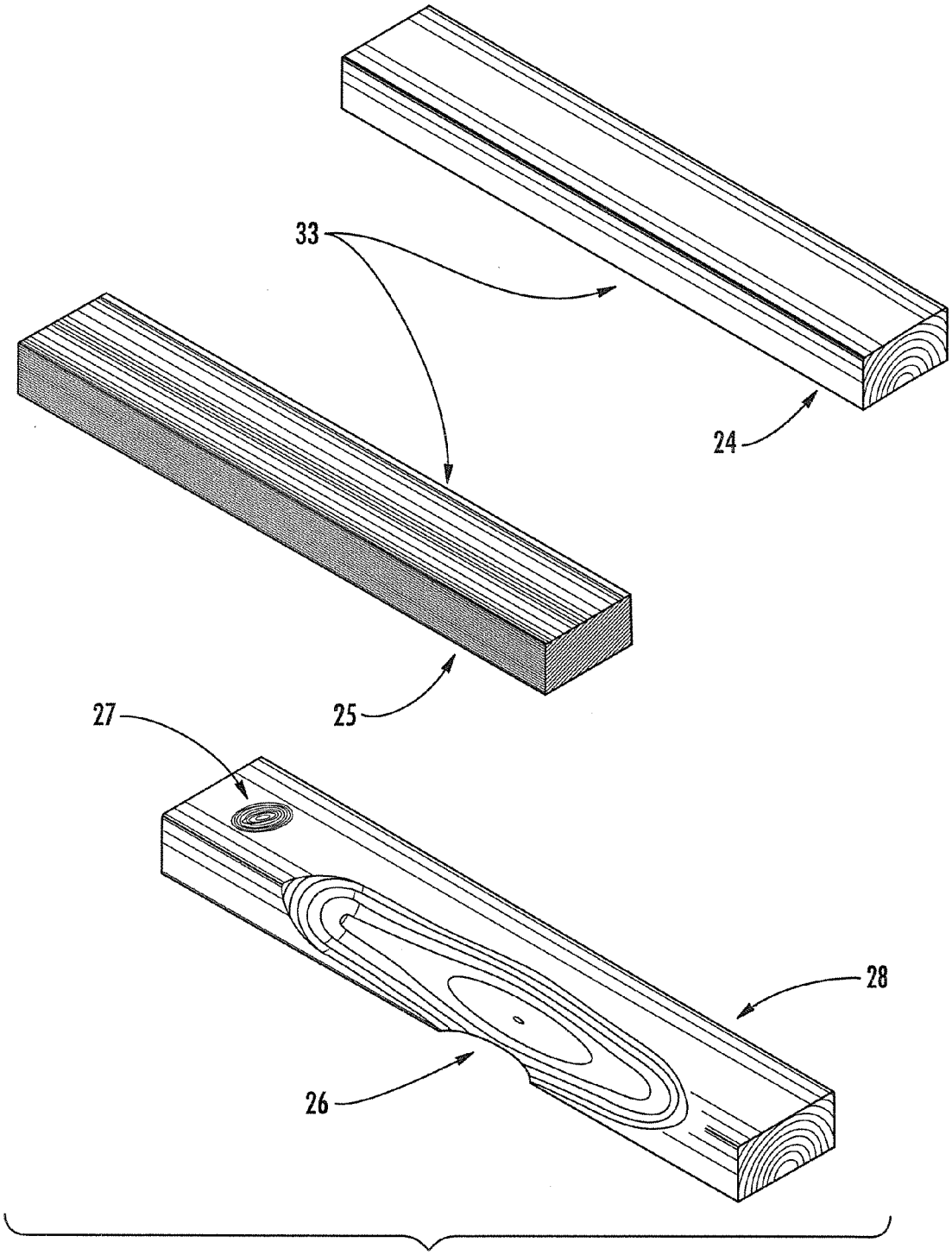
FIG. 7 is a perspective view of green rough trim blocks of different grain density and defect content.

Referring to FIGS. 2 and 7, the dry rough planed trim blocks 33 are inspected and sorted for desired criteria 155, and separated into bins 156A, 156B, 156C, 156D. The dry rough planed trim blocks 33 with defects 26, 27 and/or undesirable grain 25 (FIG. 7) are rejected blocks 28 and move as flow 153, to a chipper 157 where they are rendered into dried chips 62 and moved as flow 127 for sales at step 180.

Continuing with FIG. 7, as an example, suitable selection criterion 155 at step 150 in FIG. 2 for the dry rough planed trim blocks 33 based on coarse grain and defect content includes:

1. The coarse grain clear trim block 24 is desirable for the present invention of producing finger jointed boards.
2. A dense grain clear trim block 25 is not desirable.
3. A dry rough planed trim block 33 with edge wane 26 is not desirable for finger jointing.
4. A dry rough planed trim block 33 with knot defect 27 is not desirable for finger jointing.

The above criteria are given as examples. Multiple selection criteria 155 are used at step 150 for sorting the dry rough planed trim blocks 33 to achieve the desired finger jointed product.

Returning to FIGS. 2, 8, 9 and 10, a series of the dried rough finish sorted trim blocks 57, from group 35A, 35B, 35C, or 35D moves as flow 151 from the selected sort bin 156A, 156B, 156C, or 156D to the finger jointing process at step 160 where they are finger jointed as shown at reference numeral 620 in FIG. 8; trimmed to length as shown with reference numeral 80 in FIG. 9, and finished planed as shown with reference numerals 710, 720 in FIG. 9 to become finished finger jointed dimensional lumber and/or molding blanks prior to moving into the package maker 170 as flow 161.

One skilled in the art would recognize that the number of sort bins 156 is based on the predetermined sorting criteria 155 and is not limited to four bins as disclosed in the embodiment of FIG. 2.

Figure 8:
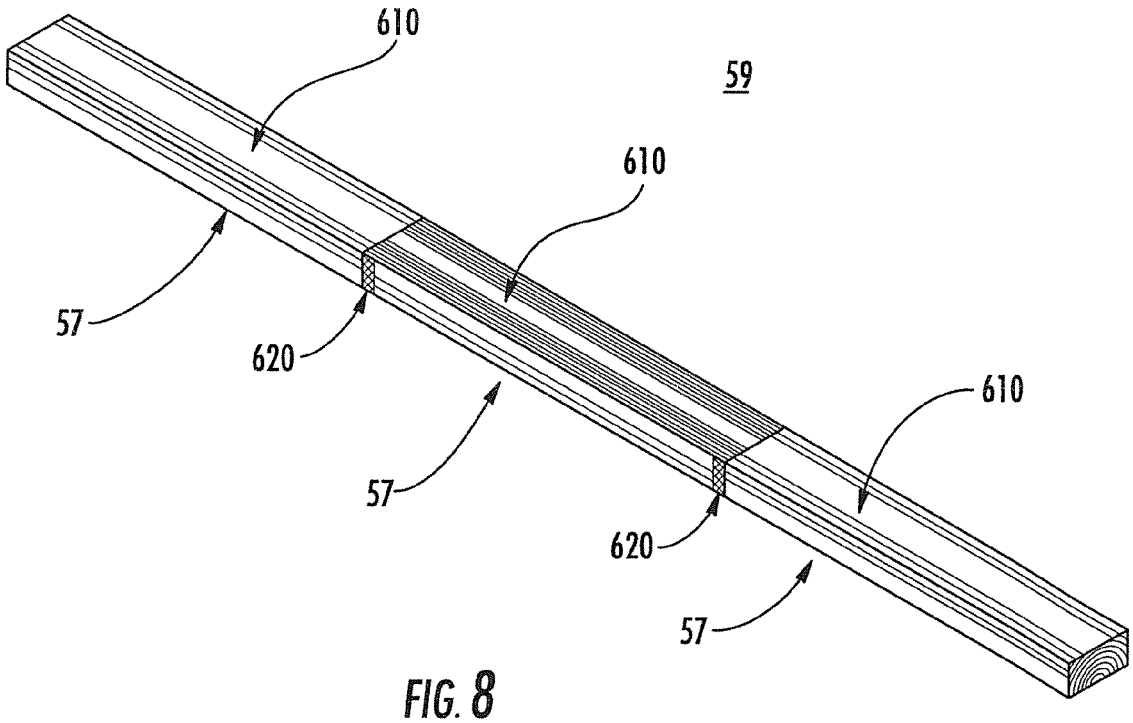
FIG. 8 is a perspective view of a rough finger jointed board produced from kiln dry rough planed trim blocks.
Figure 9:
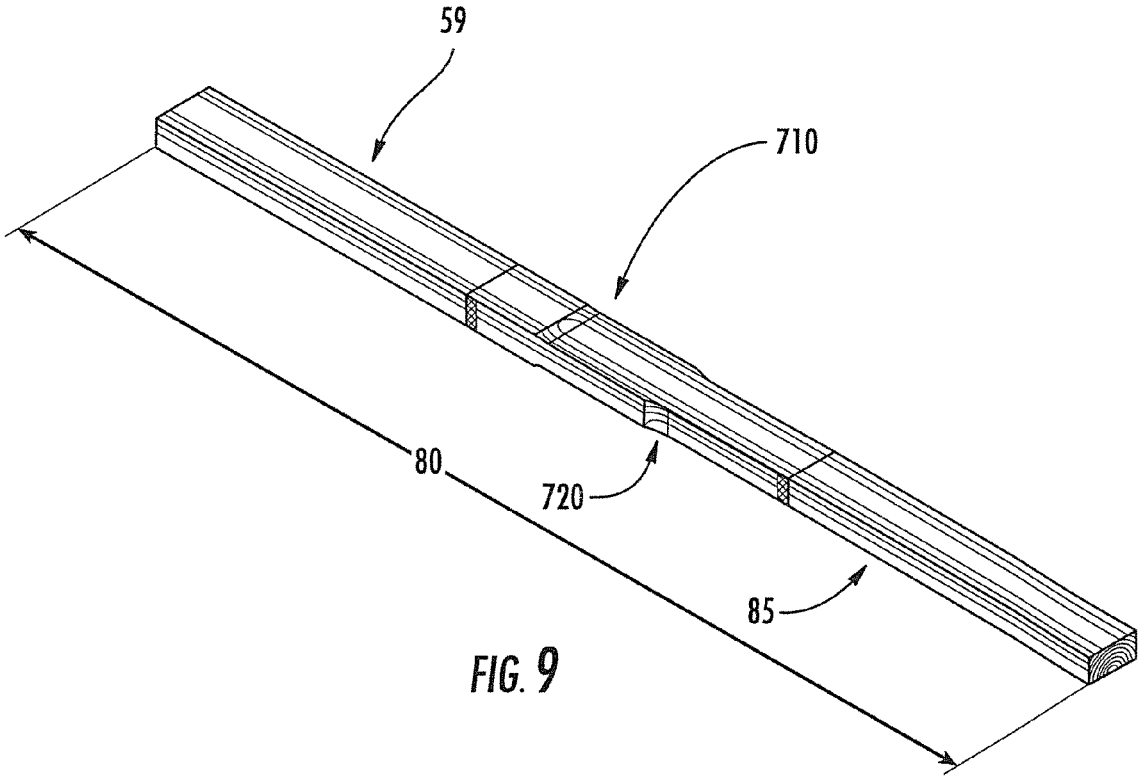
FIG. 9 is a perspective view of a finished length and partially surface finished finger jointed blocks produced from kiln dried rough trim blocks.
Figure 10:
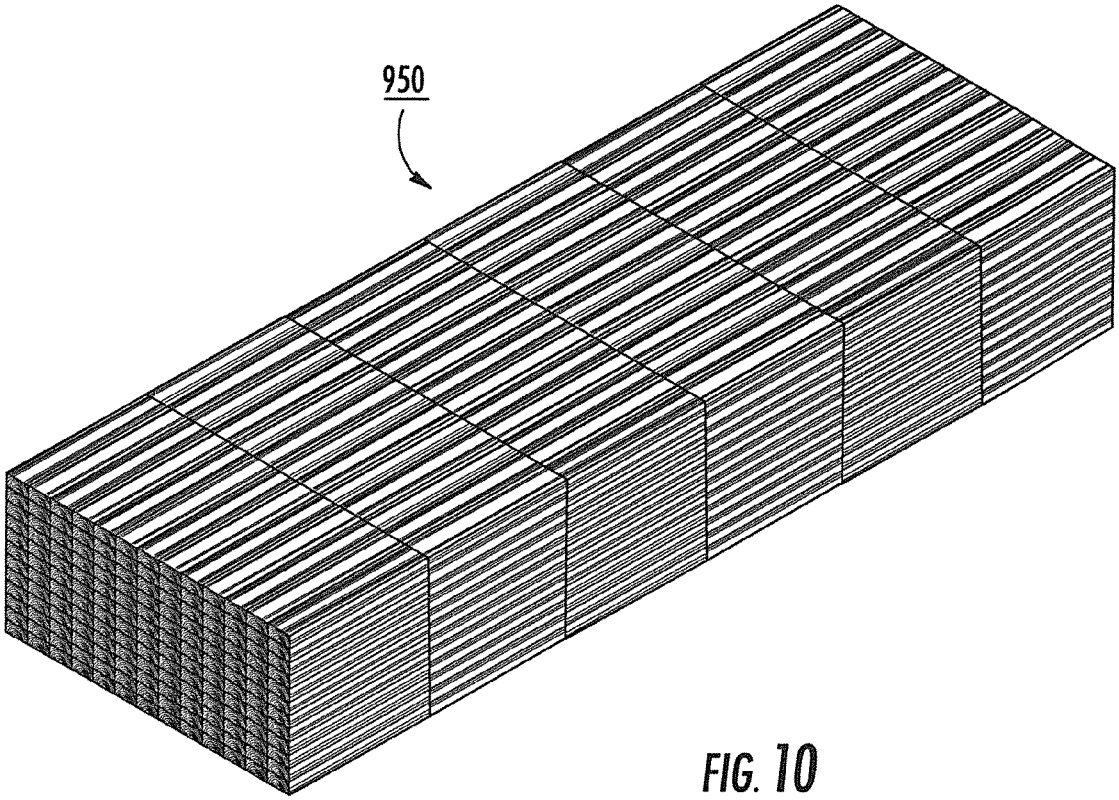
FIG. 10 is a perspective view of a stack of equal size and length finished finger jointed blocks.

In some embodiments, the dried rough finish sorted trim blocks 57 are grain oriented as illustrated as block 610 in FIG. 8 and processed by the finger joint system 100 of FIG. 2 to produce a finished finger joint 620 on the dried rough finish block 59. Grain orientation 610 improves the strength and resistance to warping of the finger jointed dimensional lumber and/or molding stock.

The finished finger jointed materials are stacked at step 950 (FIG. 10) at the package maker 170 (FIG. 2) and move as flow 171 to the sales area 180.

Figure 3:
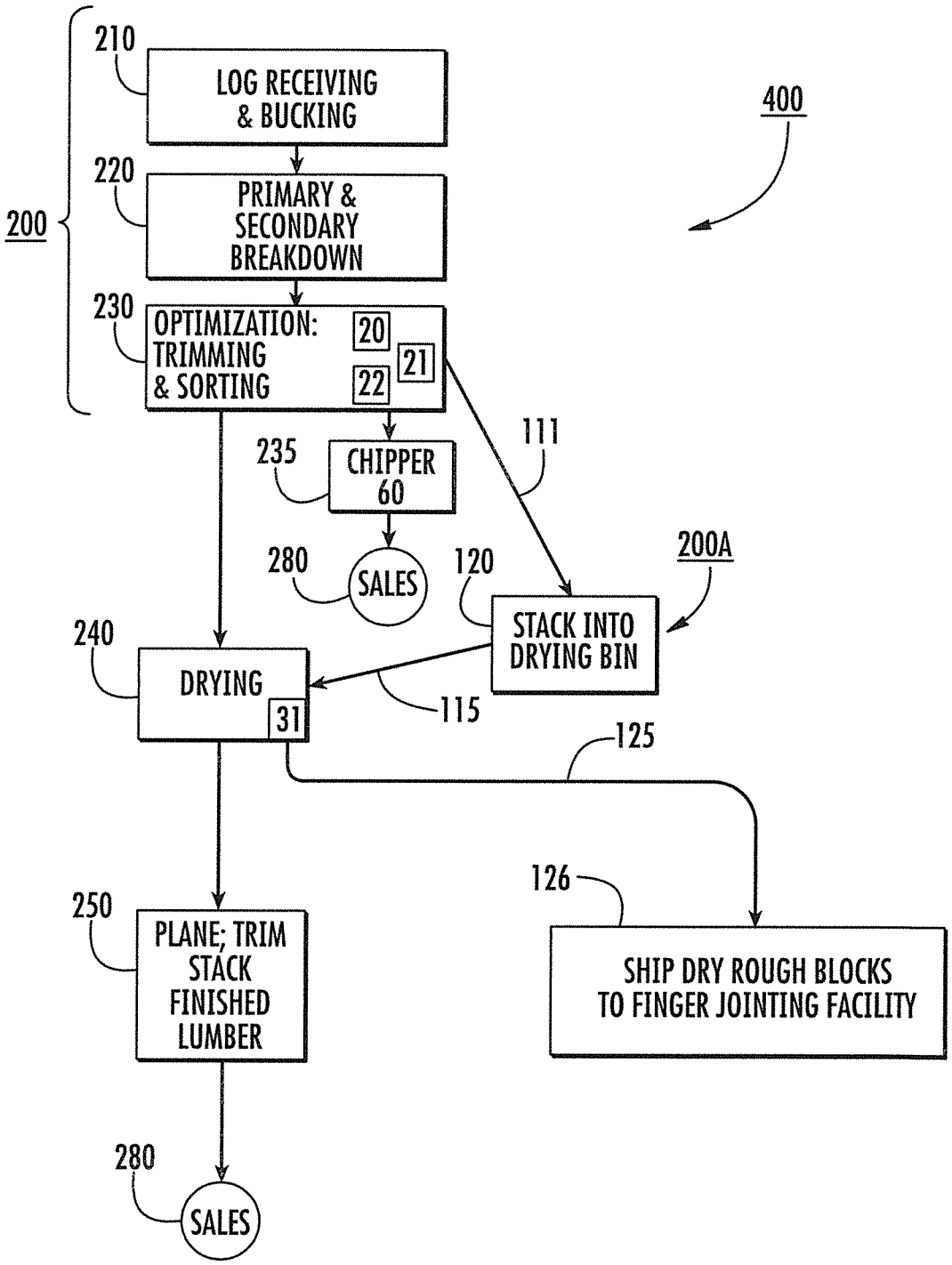
FIG. 3 is a flow diagram for the production of dried rough trim blocks at a separate lumber production plant for finger jointing at a separate facility in accordance with this invention.
Figure 3A:
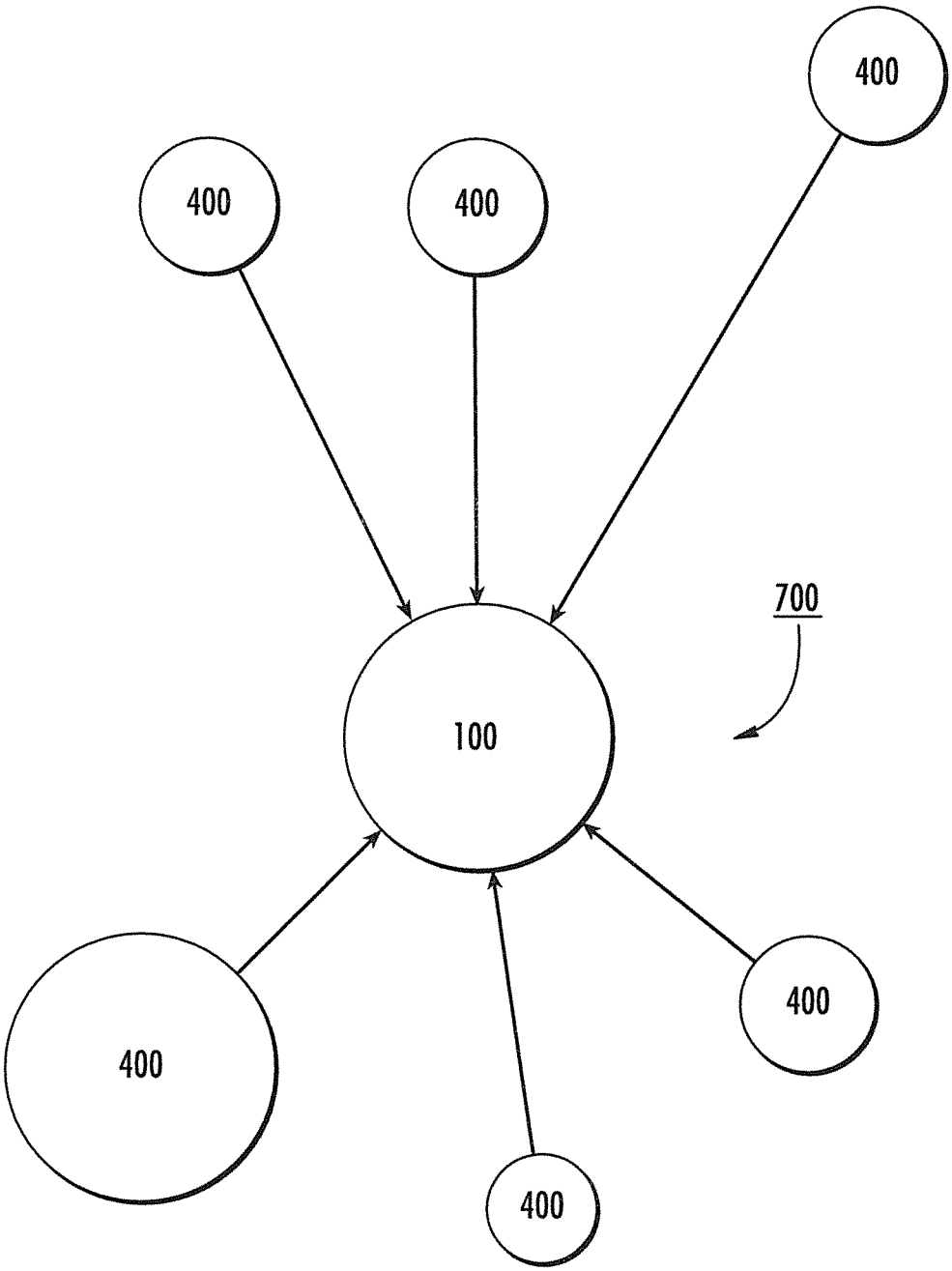
FIG. 3A is a diagram for the production of finger jointed dimensioned lumber and/or molding stock with a finger jointing plant receiving dried rough trim blocks from multiple lumber production facilities in accordance with the flow diagram of FIG. 3.
Figure 4:
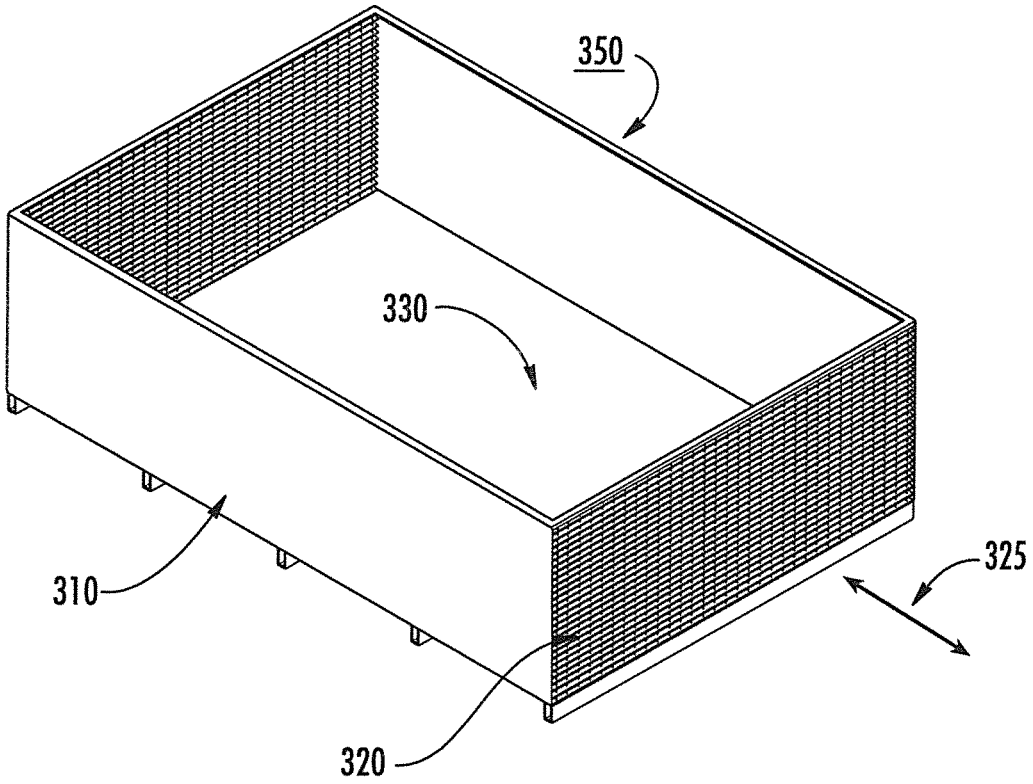
FIG. 4 is a perspective view of a container for drying green rough trim blocks.
Figure 5:
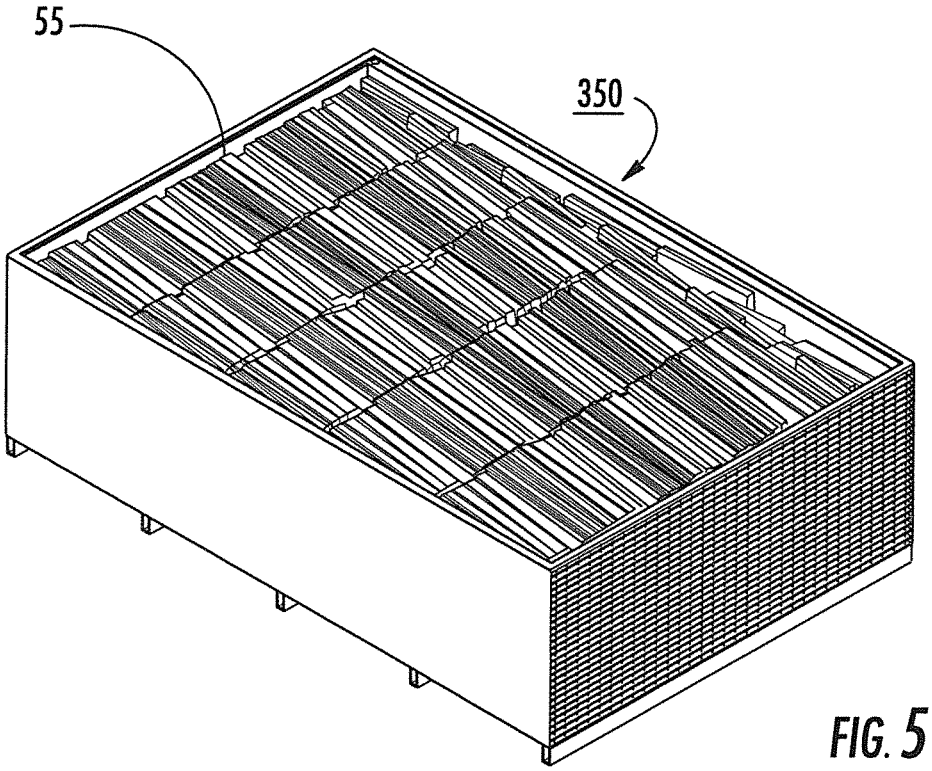
FIG. 5 is a perspective view of a container randomly filled with selected green rough trim blocks for kiln drying.

Referring to FIG. 3A, there is shown a preferred embodiment of a system 200 in accordance with this invention where the lumber production facility is 400 and the finger-joint facility 100 are not co-located together. Each lumber production facility 400 is comprised of a lumber production facility 200 (FIG. 1) and a co-located drying system 200A for the production of dry rough trim blocks 31.

Turning to FIG. 3, the system comprises a lumber production facility 200 with a drying system 200A and a shipping system 126. The green rough trim blocks 20 produced by the lumber production facility 200 shown as flow 111 are dried by the drying system 200A and shipped as flow 125 to the finger jointing facility.

Now noting FIG. 3, the lumber production facility 200 receives logs and bucks at step 210 (cut to rough lumber dimension length) for processing into dimensional lumber. Step 220 produces the primary and secondary breakdown of the bucked logs from step 210. Green rough boards are optimized, length trimmed and sorted at step 230 where green rough trim blocks 20 are produced during production of the dimensional green lumber as a by-product of the lumber production facility 200. During optimization of the green rough boards at step 230, green rough trim blocks 20 are separated into rejected green rough trim blocks 22 and green rough trim blocks 21 for drying. Rejected green rough trim blocks 22 are delivered to the chipper 235 to be rendered into green chips 60 and sold at step 280. The green rough trim blocks 21 for drying moves as flow 111 into the drying system 200A.

Turning to FIGS. 3, 4, 5, and 6, the green rough trim blocks 21 for drying are randomly stacked into a container 350 (FIG. 4) with opposing sides 320, opposing ends 310 and closed bottom 330. The container 350 with the green rough trim blocks 21 randomly stacked as shown as element 55 in FIG. 5, and then moved for drying to area 240 shown as flow 115 in FIG. 1.

The containers 350, with the randomly stacked green rough trim 21 blocks for drying are then kiln-dried by system 500 in FIG. 6. Container 350 is sized to fit with a stack of dimensional lumber inside the drying kiln 500. The container 350 is placed on the top of a stack of green dimensional lumber 510. Dry heated air 550 shown as flows 553, 555, 557 is pushed through the stack of lumber 510 and the container 350 by reversible fan 570. High moisture content air 559 enters the reheating area where the vents 580 and 581 are actuated to control the humidity of the heated air 550 and thereby controlling the rate of drying.

Reversible fan 570 forces the heated air 550 to flow in the direction as indicated as arrows 553, 555, 557 and the opposite direction when the revisable fan 570 reverses. This provides uniform drying of the kiln charge made up of the lumber stack 510 and the container 350. The dried rough trim blocks 31 are delivered as flow 125 to the finger jointing system 100. Turning now to FIG. 2, the dry rough trim blocks 31 are received by the finger jointing system 100 as flow 125 at receiving area 130. The dry rough trim blocks 31 move as flow 131 into the rough plane at step 140 where they are lightly surface planed prior to optimization at step 150. The dry rough planed trim blocks 33 move as flow 141 into the optimizer, trimmer, and sorter area 150.

Referring to FIGS. 2 and 7, the dry rough planed trim blocks 33 are inspected and sorted for desired criteria 155, and separated into bins 156A, 156B, 156C, 156D. The dry rough planed trim blocks 33 with defects 26, 27 and/or undesirable grain 25 (FIG. 7) are rejected blocks 28 and move as flow 153, to a chipper 157 where they are rendered into dried chips 62 and moved as flow 127 for sales at step 180.

Continuing with FIG. 7, as an example, suitable selection criterion 155 at step 150 in FIG. 2 for the dry rough planed trim blocks 33 based on coarse grain and defect content includes:

1. The coarse grain clear trim block 24 is desirable for the present invention of producing finger jointed boards.
2. A dense grain clear trim block 25 is not desirable.
3. A dry rough planed trim block 33 with edge wane 26 is not desirable for finger jointing.
4. A dry rough planed trim block 33 with knot defect 27 is not desirable for finger jointing.

The above criteria are given as examples. Multiple selection criteria 155 are used at step 150 for sorting the dry rough planed trim blocks 33 to achieve the desired finger jointed product.

Returning to FIGS. 2, 8, 9 and 10, a series of the dried rough finish sorted trim blocks 57, from group 35A, 35B, 35C, or 35D moves as flow 151 from the selected sort bin 156A, 156B, 156C, or 156D to the finger jointing process at step 160 where they are finger jointed as shown by reference numeral 620 in FIG. 8; trimmed to length as shown by reference numeral 80 in FIG. 9; and finished planed as shown by reference numerals 710, 720 in FIG. 9 to become finished finger jointed dimensional lumber and/or molding blanks prior to moving into the package maker 170 as flow 161.

One skilled in the art would recognize that the number of sort bins 156 is based on the predetermined sorting criteria 155 and is not limited to four bins as disclosed in the embodiment of FIG. 2.

In some embodiments, the dried rough finish sorted trim blocks 57 are grain oriented as illustrated as block 610 in FIG. 8 and processed by the finger joint system 100 of FIG. 2 to produce a finished finger joint 620 on the dried rough finish block 59. Grain orientation 610 improves the strength and resistance to warping of the finger jointed dimensional lumber and/or molding stock.

The finished finger jointed materials are stacked at step 950 (FIG. 10) at the package maker 170 (FIG. 2) and move as flow 171 to the sales area 180.

In other embodiments, the rough planed finger jointed blocks are sold to specialty production plants for the manufacturing of molding.

The finger jointing technique described above using green trim blocks to make dimensional lumber is also applicable to the use of delimbed and bucked logs for the fabrication of poles (such as utility poles, for example) and beams as will now be described with reference to FIGS. 11 and 12.

Figure 11:
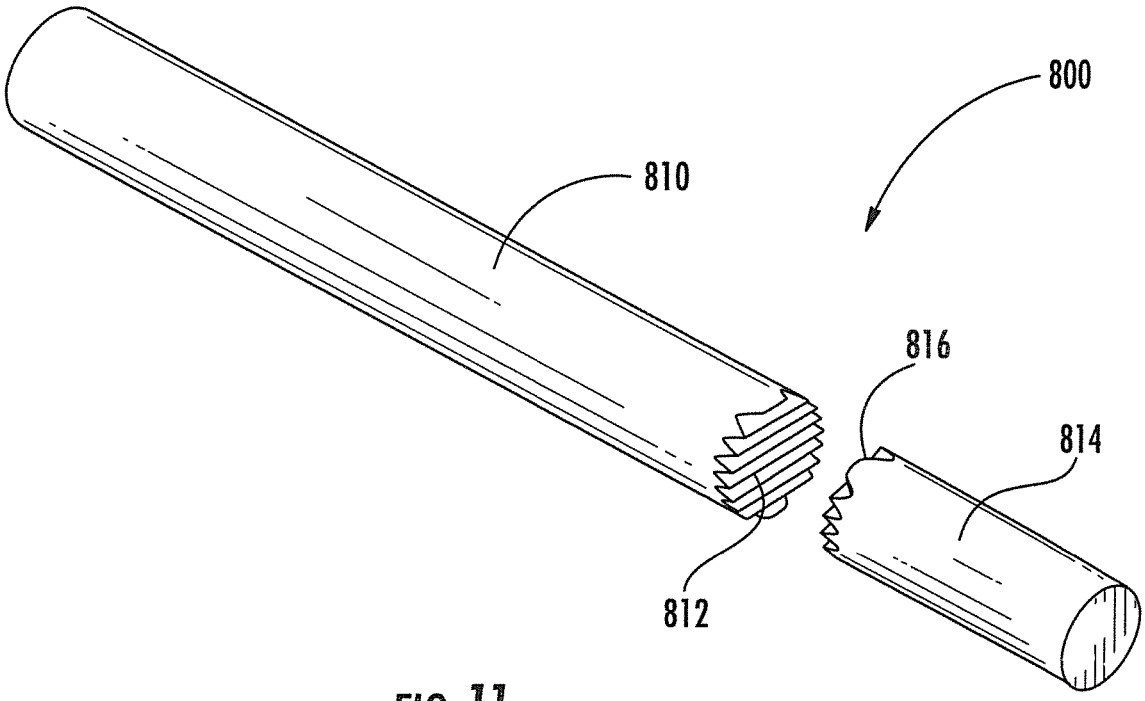
FIG. 11 is an exploded perspective view of a finger jointed pole according to this invention.

Noting FIG. 11, a pole 800 of a desired dimension is made from log segments 810 and 814, each of which has a respective end 812, 816 that has been prepared for finger jointing. After finger jointing and setting of the adhesive, the log 800 formed of the segments 810 and 814 is then planed to a desired uniform diameter consistent with the needs of a pole application, again such as a utility pole.

Figure 12:
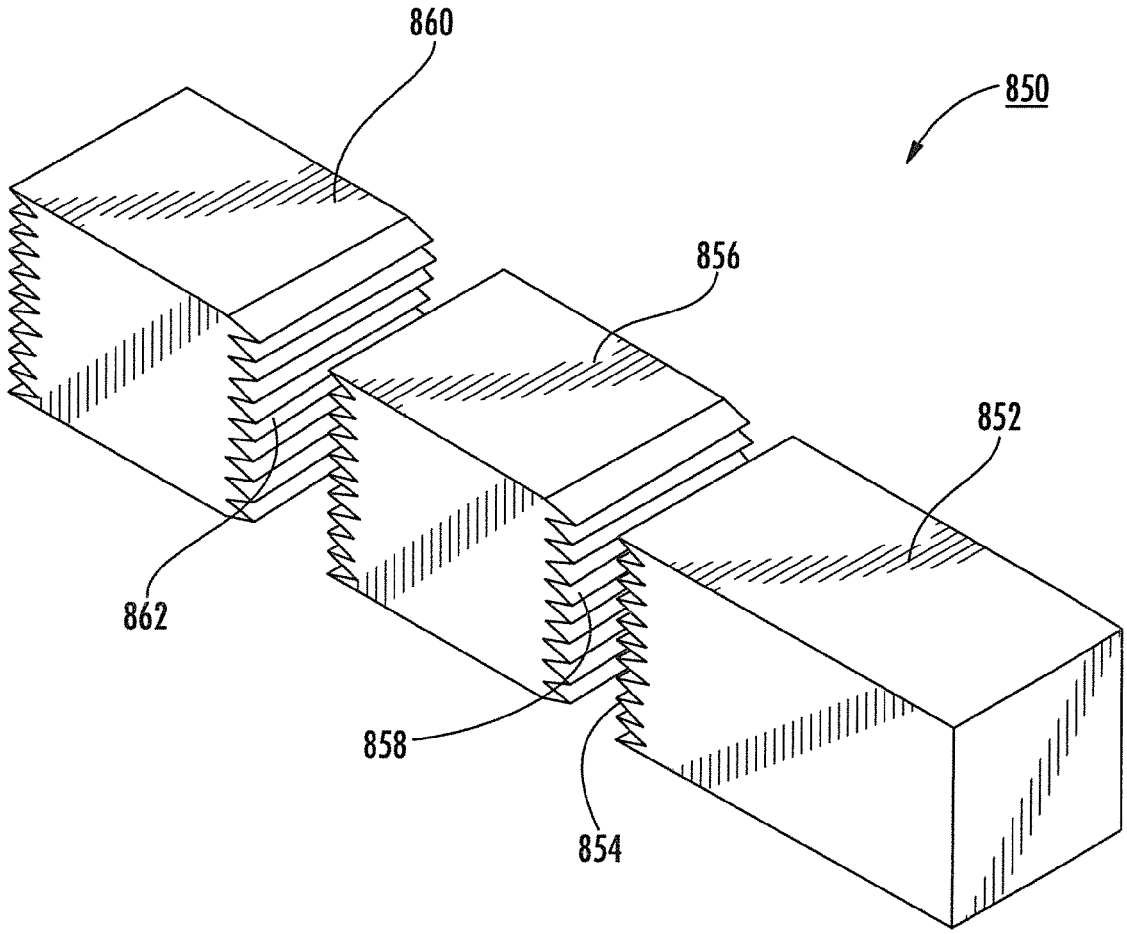
FIG. 12 is an exploded perspective of a finger jointed beam according to this invention.

FIG. 12 illustrates a beam 850 of a desired length fabricated from three beam segments 852, 856 and 860 each of which has a respective end 854, 858 and 862 finished with fingers suitable for jointing with the adjacent one of the segments in order to obtain a beam 850 of the desired length; it will be appreciated that other segments may be added to achieve the desired beam length.

While the invention has been described with respect to certain specific embodiments, it will be appreciated that many modifications and changes may be made by those skilled in the art without departing from the spirit and scope of this invention.

What is claimed is:

1. A method for the production of finger-jointed lumber from green rough trim blocks, the method comprising the steps of:

preparing bucked logs;

sawing the bucked logs into dimensional lumber of a desired length, the sawing also resulting in green rough trim blocks having a length less than the desired length;

drying the green rough trim blocks to a desired reduced moisture content;

drying the dimensional lumber, the dimensional lumber being dried simultaneously with the green rough trim blocks; and thereafter finger-jointing a plurality of the dried trim blocks end-to-end.

2. The method recited in claim 1, further comprising the step of trimming lengths of the finger-jointed dried trim blocks to a predetermined length.

3. The method recited in claim 2 wherein the predetermined length is essentially the same as the desired length of the dimensional lumber.

4. The method recited in claim 1 further comprising the step of sorting the trim blocks according to predetermined criteria before drying.

5. The method recited in claim 4 wherein:

the sorting step comprises determining which trim blocks are to be rejected and which are acceptable; and thereafter feeding the rejected trim blocks to a chipper.

6. The method recited in claim 5 wherein drying the green rough trim blocks is performed after the sorting step, such that rejected trim blocks are not dried with the acceptable trim blocks; and thereafter feeding the acceptable trim blocks into a finger-jointing unit.

7. The method recited in claim 6 further comprising the steps of:

carrying out the sawing step at a sawmill; and co-locating the finger-jointing unit with the sawmill.

8. The method recited in claim 6 further comprising the steps of:

conducting a further determination of which dried trim blocks are acceptable and which are to be rejected; and thereafter feeding the rejected dried trim blocks to a chipper.

9. The method recited in claim 6 further comprising the step of trimming the finger-jointed lengths to the desired length.

10. The method recited in claim 9 further comprising the step of trimming sides of the finger jointed lengths.

11. The method recited in claim 1 wherein the drying step comprises the steps of:

placing the dimensional lumber into a kiln for drying;

placing the green rough trim blocks in a container within the kiln atop the dimensional lumber; and thereafter subjecting the dimensional lumber and the trim blocks with heat to reduce the moisture content of both the dimensional lumber and the trim blocks.

12. The method recited in claim 1, further comprising the step of processing the dried finger jointed trim blocks into one of dimensional lumber, molding stock, poles and beams.

13. A method for the production of finger-jointed lumber from green rough trim blocks, the method comprising the steps of:

preparing bucked logs;

sawing the bucked logs into dimensional lumber of a desired length, the sawing also resulting in green rough trim blocks having a length less than the desired length;

drying the green rough trim blocks to a desired reduced moisture content; and thereafter finger-jointing a plurality of the dried trim blocks end-to-end;

wherein the drying step comprises the steps of:

placing the dimensional lumber into a kiln for drying;

placing the green rough trim blocks in a container within the kiln atop the dimensional lumber; and thereafter subjecting the dimensional lumber and the trim blocks with heat to reduce the moisture content of both the dimensional lumber and the trim blocks.

* * * * *